US012123412B2

(12) United States Patent
De Bock et al.

(10) Patent No.: US 12,123,412 B2
(45) Date of Patent: Oct. 22, 2024

(54) CONTROL OF OPERATING LIQUID FLOW INTO A LIQUID RING PUMP

(71) Applicant: Edwards Technologies Vacuum Engineering (Qingdao) Co Ltd, Shandong (CN)

(72) Inventors: Andries Daniel Jozef De Bock, Shandong (CN); Xibo Liu, Shandong (CN); Quanxi Jiang, Shandong (CN); Xin Dai, Shandong (CN)

(73) Assignee: Edwards Technologies Vacuum Engineering (Qingdao) Company Limited

( * ) Notice: Subject to any disclaimer, the term of this patent is extended or adjusted under 35 U.S.C. 154(b) by 69 days.

(21) Appl. No.: 18/042,696

(22) PCT Filed: Aug. 28, 2020

(86) PCT No.: PCT/CN2020/112045
§ 371 (c)(1),
(2) Date: Feb. 23, 2023

(87) PCT Pub. No.: WO2022/041106
PCT Pub. Date: Mar. 3, 2022

(65) Prior Publication Data

US 2023/0332601 A1 Oct. 19, 2023

(51) Int. Cl.
*F04C 19/00* (2006.01)
*F04C 28/24* (2006.01)
*F04C 28/28* (2006.01)

(52) U.S. Cl.
CPC ..... *F04C 19/004* (2013.01); *F04C 19/00* (2013.01); *F04C 28/24* (2013.01); *F04C 28/28* (2013.01);
(Continued)

(58) Field of Classification Search
CPC ..... F04C 28/24; F04C 28/28; F04C 19/00; F04C 19/004; F04C 2270/18; F04C 2270/19; F04C 2270/205
(Continued)

(56) References Cited

U.S. PATENT DOCUMENTS 4,655,688 A * 4/1987 Bohn ..... F04C 19/001 417/18
5,366,348 A * 11/1994 Skelton ..... F04C 19/004 417/244
(Continued)

FOREIGN PATENT DOCUMENTS

CN 105026758 A 11/2015
CN 105782058 A 7/2016
(Continued)

OTHER PUBLICATIONS

European Communication dated May 13, 2024 and Supplementary European Search Report dated Apr. 24, 2024 for corresponding European application Serial No. EP20950776, 6 pages.
(Continued)

*Primary Examiner* — Christopher S Bobish
(74) *Attorney, Agent, or Firm* — Theodore M. Magee; Westman, Champlin & Koehler, P.A.

(57) ABSTRACT

A control system comprising: a suction line; an exhaust line; an operating liquid line; a liquid ring pump coupled to the suction, exhaust, and operating liquid lines; a regulating device configured to control flow of operating liquid into the liquid ring pump; a pressure sensor configured to measure a pressure of an input fluid to the liquid ring pump via the suction line; a first temperature sensor configured to measure temperature of an exhaust fluid output by the liquid ring pump via the exhaust line; a second temperature sensor configured to measure temperature of an operating liquid received by the liquid ring pump via the operating liquid
(Continued)

line; and a controller configured to: using the sensor measurements control the one or more regulating devices.

15 Claims, 4 Drawing Sheets

(52) U.S. Cl.
CPC ..... *F04C 2270/18* (2013.01); *F04C 2270/19* (2013.01); *F04C 2270/205* (2013.01); *F04C 2270/86* (2013.01)

(58) Field of Classification Search
USPC ..... 417/68
See application file for complete search history.

(56) References Cited

U.S. PATENT DOCUMENTS

| | | | | |
|---|---|---|---|---|
| 6,227,222 | B1 * | 5/2001 | Jennings | E21B 43/34 137/171 |
| 11,746,785 | B2 * | 9/2023 | De Bock | F04D 17/10 417/32 |
| 2009/0199908 | A1 | 8/2009 | Arnalsteen et al. | |
| 2011/0274592 | A1 * | 11/2011 | Salmisuo | A61L 2/26 422/292 |
| 2018/0245594 | A1 * | 8/2018 | Chabala | F04C 28/06 |
| 2023/0243353 | A1 * | 8/2023 | De Bock | F04C 19/00 417/68 |

FOREIGN PATENT DOCUMENTS

| | | | |
|---|---|---|---|
| CN | 107246807 | A | 10/2017 |
| GB | 2572035 | A | 9/2019 |
| JP | H1182346 | A | 3/1999 |
| WO | 2019175822 | A1 | 3/2019 |
| WO | 2019175823 | A1 | 9/2019 |

OTHER PUBLICATIONS

British Examination Report dated Jun. 10, 2022 for corresponding British application Serial No. GB2019761.2, 2 pages.
British Search Report dated May 18, 2021 for corresponding British application Serial No. GB2019761.2, 4 pages.
PCT Notification of Transmittal of the International Search Report and the Written Opinion of the International Searching Authority of the Declaration and PCT International Search Report dated May 26, 2021 for PCT application Serial No. PCT/CN2020/112045, 6 pages.
PCT International Written Opinion dated May 26, 2021 for PCT application Serial No. PCT/CN2020/112045, 4 pages.
PCT International Preliminary Report on Patentability dated Dec. 15, 2022 for PCT application Serial No. PCT/CN2020/112045, 7 pages.
Response to Written Opinion dated Feb. 25, 2022 for PCT application Serial No. PCT/CN2020/112045, 2 pages.

* cited by examiner

CONTROL OF OPERATING LIQUID FLOW INTO A LIQUID RING PUMP

CROSS-REFERENCE OF RELATED APPLICATION

This application is a Section 371 National Stage Application of International Application No. PCT/CN2020/112045, filed Aug. 28, 2020, and published as WO 2022/041106A1 on Mar. 3, 2022, the content of which is hereby incorporated by reference in its entirety.

FIELD

The present invention relates to the control of the flow of an operating liquid, such as water, into liquid ring pumps.

BACKGROUND

Liquid ring pumps are a known type of pump which are typically commercially used as vacuum pumps and as gas compressors. Liquid ring pumps typically include a housing with a chamber therein, a shaft extending into the chamber, an impeller mounted to the shaft, and a drive system such as a motor operably connected to the shaft to drive the shaft. The impeller and shaft are positioned eccentrically within the chamber of the liquid ring pump.

In operation, the chamber is partially filled with an operating liquid (also known as a service liquid). When the drive system drives the shaft and the impeller, a liquid ring is formed on the inner wall of the chamber, thereby providing a seal that isolates individual volumes between adjacent impeller vanes. The impeller and shaft are positioned eccentrically to the liquid ring, which results in a cyclic variation of the volumes enclosed between adjacent vanes of the impeller and the liquid ring.

In a portion of the chamber where the liquid ring is further away from the shaft, there is a larger volume between adjacent impeller vanes which results in a smaller pressure therein. This allows the portion where the liquid ring is further away from the shaft to act as a gas intake zone. In a portion of the chamber where the liquid ring is closer to the shaft, there is a smaller volume between adjacent impeller vanes which results in a larger pressure therein. This allows the portion where the liquid ring is closer to the shaft to act as a gas discharge zone.

Examples of liquid ring pumps include single-stage liquid ring pumps and multi-stage liquid ring pumps. Single-stage liquid ring pumps involve the use of only a single chamber and impeller. Multi-stage liquid ring pumps (e.g. two-stage) involve the use of multiple chambers and impellers connected in series.

The discussion above is merely provided for general background information and is not intended to be used as an aid in determining the scope of the claimed subject matter. The claimed subject matter is not limited to implementations that solve any or all disadvantages noted in the background.

SUMMARY

The suction ability of a liquid ring vacuum pump can be influenced by adjusting the temperature of the operating liquid used in that liquid ring pump. For example, at high vacuum levels, greater liquid ring pump efficiency tends to be achieved by lowering the temperature of the operating liquid. Conventionally, where water is used as the operating liquid, the provision of lower temperature operating liquid is typically achieved by providing an open operating liquid circuit in which heated operating liquid from the liquid ring pump is expelled and replaced by cool, fresh operating liquid. Accordingly, liquid ring pumps can consume considerable amounts of fresh water.

The present inventors have realised it is desirable to provide for controlling of operating liquid temperature and/or pressure of a liquid ring pump in a way that minimises power consumption. Such control advantageously tends to reduce operating costs of the liquid ring pump.

The present inventors have further realised it is desirable to provide for controlling of a liquid ring pump in a way that prevents or opposes cavitation in that liquid ring vacuum pump. Cavitation tends to be a significant cause of wear and failure in certain liquid ring pumps, especially those operating at a low-pressure/high-vacuum condition. Such control advantageously tends to reduce or eliminate wear caused by cavitation.

In a first aspect, there is provided a control system comprising: a suction line; an exhaust line; an operating liquid line; a liquid ring pump comprising a suction input coupled to the suction line, an exhaust output coupled to the exhaust line, and a liquid input coupled to the operating liquid line; one or more regulating devices configured to control flow of operating liquid into the liquid ring pump; a pressure sensor configured to measure a pressure of an input fluid received by the liquid ring pump via the suction line; a first temperature sensor configured to measure temperature of an exhaust fluid output by the liquid ring pump via the exhaust line; a second temperature sensor configured to measure temperature of an operating liquid received by the liquid ring pump via the operating liquid line; and a controller configured to: using the temperature measurement of the exhaust fluid, determine or estimate a vapour pressure of the operating liquid in the liquid ring pump; perform a first comparison, the first comparison being a comparison between a function of the measured pressure of the input fluid and a function of the determined or estimated a vapour pressure; responsive to the first comparison fulfilling one or more criteria, control the one or more regulating devices to increase a flowrate of the operating liquid into the liquid ring pump; responsive to the first comparison not fulfilling the one or more criteria, perform a second comparison, the second comparison being a comparison between a function of the temperature measurement of the exhaust fluid and a function of the temperature measurement of the operating liquid; and control the one or more regulating devices based on the second comparison. This control system advantageously tends to allow for the intelligent handling of variable and uncertain load conditions which may otherwise cause shutdown of the pumping system, while simultaneously achieving improved water and energy savings.

The vapour pressure of the operating liquid may be determined as:

$$P_{wv} = A * 10^{\left(\frac{m * T_1}{T_1 + T_n}\right)}$$

where: A is a constant value; m is a constant value; $T_n$ is a constant value; and $T_1$ is the temperature measurement of the exhaust fluid.

The first comparison may comprise determining a difference between the measured pressure of the input fluid and some function of the determined or estimated vapour pressure. The one or more criteria may comprise the criterion that the difference between the measured pressure of the input fluid and some function of the determined or estimated a vapour pressure is less than or equal to a first threshold value. The first threshold may be zero.

The controller may be configured to, responsive to the first comparison fulfilling the one or more criteria, control the one or more regulating devices to increase the flowrate of the operating liquid into the liquid ring pump to a maximum flow rate.

The second comparison may comprise determining a difference between the temperature measurement of the exhaust fluid and the temperature measurement of the operating liquid. The controller may be configured to, responsive to the difference between the temperature measurement of the exhaust fluid and the temperature measurement of the operating liquid being above a second threshold value, control the one or more regulating devices to increase the flowrate of the operating liquid into the liquid ring pump. The controller may be configured to, responsive to the difference between the temperature measurement of the exhaust fluid and the temperature measurement of the operating liquid being below a second threshold value, control the one or more regulating devices to decrease the flowrate of the operating liquid into the liquid ring pump. The controller may be configured to, responsive to the difference between the temperature measurement of the exhaust fluid and the temperature measurement of the operating liquid being equal to a second threshold value, control the one or more regulating devices to maintain a current flowrate of the operating liquid into the liquid ring pump. The second threshold may be variable, e.g. selectable by a user. The second threshold may be set to be equal to a first value for wet processes (i.e. wet pumping processes). The second threshold may be set to be equal to a second value for dry processes (i.e. dry pumping processes). The first value may be different to the second value.

The controller may be a controller selected from the group of controllers consisting of a proportional controller, an integral controller, a derivative controller, a proportional-integral controller, a proportional-integral-derivative controller, a proportional-derivative controller, and a fuzzy logic controller.

The one or more regulating devices may comprise one or more devices selected from the group of devices consisting of: a pump, a centrifugal pump, a valve, a proportional valve.

In a further aspect, there is provided a method for controlling a system, the system comprising a suction line an exhaust line, an operating liquid line, a liquid ring pump comprising a suction input coupled to the suction line, an exhaust output coupled to the exhaust line, and a liquid input coupled to the operating liquid line, one or more regulating devices configured to control flow of operating liquid into the liquid ring pump, a pressure sensor, a first temperature sensor, and a second temperature sensor. The method comprises:

measuring, by the pressure sensor, a pressure of an input fluid received by the liquid ring pump via the suction line; using a temperature measurement of the exhaust fluid, determining or estimating a vapour pressure of the operating liquid in the liquid ring pump; performing a first comparison, the first comparison being a comparison between a function of the measured pressure of the input fluid and a function of the determined or estimated a vapour pressure; responsive to the first comparison fulfilling one or more criteria, controlling the one or more regulating devices to increase a flowrate of the operating liquid into the liquid ring pump; measuring, by the first temperature sensor, a temperature of an exhaust fluid output by the liquid ring pump via the exhaust line; measuring, by the second temperature sensor, a temperature of an operating liquid received by the liquid ring pump via the operating liquid line; responsive to the first comparison not fulfilling the one or more criteria, performing a second comparison, the second comparison being a comparison between a function of the temperature measurement of the exhaust fluid and a function of the temperature measurement of the operating liquid; and controlling the one or more regulating devices based on the second comparison.

The Summary is provided to introduce a selection of concepts in a simplified form that are further described in the Detailed Description. This summary is not intended to identify key features or essential features of the claimed subject matter, nor is it intended to be used as an aid in determining the scope of the claimed subject matter.

DETAILED DESCRIPTION

Figure 1:
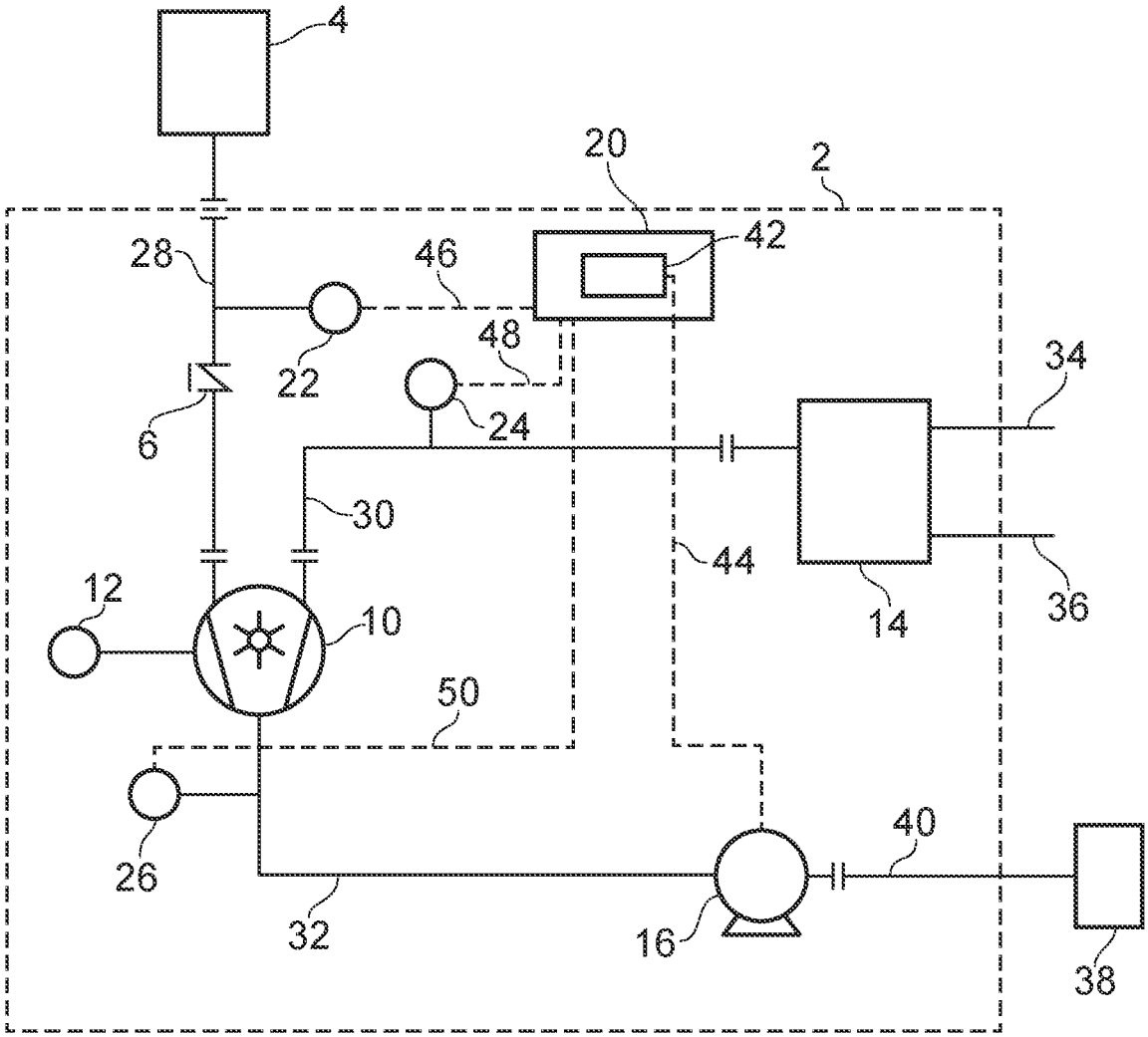
FIG. 1 is a schematic illustration (not to scale) showing a vacuum system.

FIG. 1 is a schematic illustration (not to scale) showing a vacuum system 2. The vacuum system 2 is coupled to a facility 4 such that, in operation, the vacuum system 2 establishes a vacuum or low-pressure environment at the facility 4 by drawing gas (for example, air) from the facility 4.

In this embodiment, the vacuum system 2 comprises a non-return valve 6, a liquid ring pump 10, a motor 12, a separator 14, a pump system 16, a controller 20, a pressure sensor 22, a first temperature sensor 24, and a second temperature sensor 26.

The facility 4 is connected to an inlet of the liquid ring pump 10 via a suction or vacuum line or pipe 28.

The non-return valve 6 is disposed on the suction line 28. The non-return valve 6 is disposed between the facility 4 and the liquid ring pump 10.

The non-return valve 6 is configured to permit the flow of fluid (e.g. a gas such as air) from the facility 4 to the liquid ring pump 10, and to prevent or oppose the flow of fluid in the reverse direction, i.e. from the liquid ring pump 10 to the facility 4.

In this embodiment, the liquid ring pump 10 is a single-stage liquid ring pump.

A gas inlet of the liquid ring pump 10 is connected to the suction line 28. A gas outlet of the liquid ring pump 10 is connected to an exhaust line or pipe 30. The liquid ring pump 10 is coupled to the pump system 16 via a first operating liquid pipe 32. The liquid ring pump 10 is configured to receive the operating liquid from the pump system 16 via the first operating liquid pipe 32. The liquid ring pump 10 is driven by the motor 12.

Figure 2:
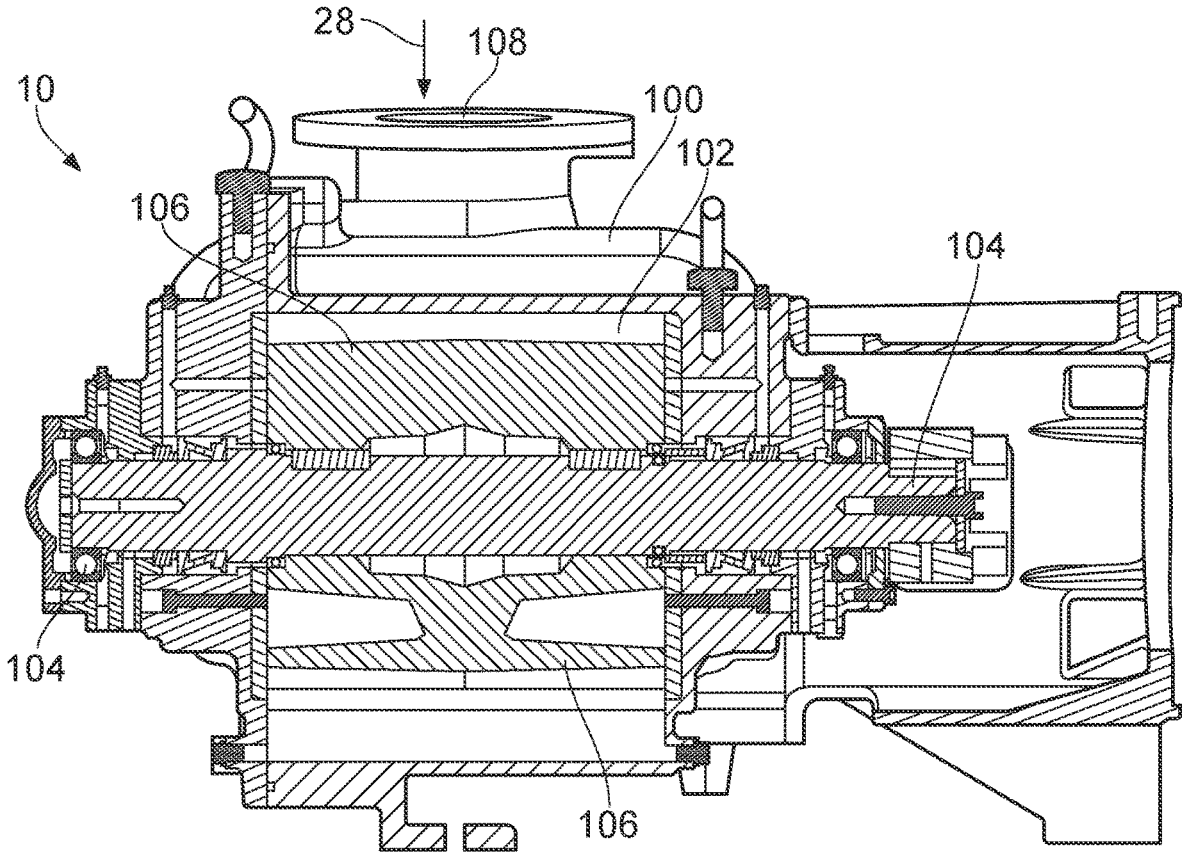
FIG. 2 is a schematic illustration (not to scale) of a liquid ring pump.

FIG. 2 is a schematic illustration (not to scale) of a cross section of an example liquid ring pump 10. The remainder of the vacuum system 2 will be described in more detail later below after a description of the liquid ring pump 10 shown in FIG. 2.

The liquid ring pump 10 illustrated in FIG. 2 comprises a housing 100 that defines a substantially cylindrical chamber 102, a shaft 104 extending into the chamber 102, and an impeller 106 fixedly mounted to the shaft 104. The gas inlet 108 of the liquid ring pump 10 (which is coupled to the suction line 28) is fluidly connected to a gas intake of the chamber 102. The gas outlet (not shown in FIG. 2) of the liquid ring pump 10 is fluidly connected to a gas output of the chamber 102.

During operation of the liquid ring pump 10, the operating liquid is received in the chamber 102 via the first operating liquid pipe 32. Also, the shaft 104 is rotated by the motor 12, thereby rotating the impeller 106 within the chamber 102. As the impeller 106 rotates, the operating liquid in the chamber 102 (not shown in the Figures) is forced against the walls of the chamber 102 thereby to form a liquid ring that seals and isolates individual volumes between adjacent impeller vanes. Also, gas (such as air) is drawn into the chamber 102 from the suction line 28 via the gas inlet 108 and the gas intake of the chamber 102. This gas flows into the volumes formed between adjacent vanes of the impeller 106. Rotation of the impeller 106 causes said volumes to reduce in size. The rotation of the impeller 106 compresses the gas contained within the volume as it is moved from the gas intake of the chamber 102 to the gas output of the chamber 102, where the compressed gas exits the chamber 102. Compressed gas exiting the chamber 102 then exits the liquid ring pump via the gas outlet and the exhaust line 30.

Returning now to the description of FIG. 1, the exhaust line 30 is coupled between the gas outlet of the liquid ring pump 10 and an inlet of the separator 14. The separator 14 is connected to the liquid ring pump 10 via the exhaust line 30 such that exhaust fluid (i.e. compressed gas, which may include water droplets and/or vapour) is received by the separator 14.

The separator 14 is configured to separate the exhaust fluid received from the liquid ring pump 10 into gas (e.g. air) and the operating liquid.

The gas separated from the received exhaust fluid is expelled from the separator 14, and the vacuum system 2, via a system outlet pipe 34.

The separator 14 comprises an operating liquid outlet via which the operating fluid separated from the received exhaust fluid is output from the separator 14, and the vacuum system 2, via a drain or evacuation pipe 36.

In this embodiment, the pump system 16 comprises a pump (e.g. a centrifugal pump) and a motor configured to drive that pump. The pump system 16 is configured to pump operating liquid from an operating liquid source 38 via a second operating liquid pipe 40, and to pump that operating liquid to the liquid ring pump via the first operating liquid pipe 32.

The operating liquid source 38 may be any appropriate source of the operating liquid. For example, in embodiments in which the operating liquid is water, the operating liquid source 38 may be a mains water supply, a river, a lake, a water storage tanks, etc.

The controller 20 may comprise one or more processors. In this embodiment, the controller 20 comprises a variable frequency drive (VFD) 42. The VFD 42 is configured to control the speed of the motor of the pump system 16. As described in more detail later below with reference to FIGS. 3 and 4, the controller 20 is configured to receive sensor measurements from the sensors 22-26. The controller 20 is further configured to process some or all of these sensor measurements, and based on this sensor data processing control operation of the pump system 16, via the VFD 42.

The controller 20 is connected to the pump system 16 via its VFD 42 and via a first connection 44 such that a control signal for controlling the pump system 16 may be sent from the controller 20 to the motor of the pump system 16. The first connection 44 may be any appropriate type of connection including, but not limited to, an electrical wire or an optical fibre, or a wireless connection. The pump system 16 is configured to operate in accordance with the control signal received by it from the controller 20. Control of the pump system 16 by the controller 20 is described in more detail later below with reference to FIGS. 3 and 4.

The pressure sensor 22 is coupled to the suction line 28 between the facility 4 and the non-return valve 6. The pressure sensor 22 is configured to measure a pressure of the gas flowing in the suction line 28, i.e. the pressure of the gas being pumped from the facility 4 by the action of the liquid ring pump 10. The pressure sensor 22 may be any appropriate type of pressure sensor. The pressure sensor 22 is connected to the controller 20 via a second connection 46 such that the measurements taken by the pressure sensor 22 are sent from the pressure sensor 22 to the controller 20. The second connection 46 may be any appropriate type of connection including, but not limited to, an electrical wire or an optical fibre, or a wireless connection.

The first temperature sensor 24 is coupled to the exhaust line 30 between the liquid ring pump 10 and the separator 14. The first temperature sensor 24 is configured to measure a temperature of the exhaust fluid of the liquid ring pump 10 flowing in the exhaust line 30, i.e. the temperature of the air and water mixture being pumped by the liquid ring pump 10 to the separator 14. The first temperature sensor 24 may be any appropriate type of temperature sensor. The first temperature sensor 24 is connected to the controller 20 via a third connection 48 such that the measurements taken by the first temperature sensor 24 are sent from the first temperature sensor 24 to the controller 20. The third connection 48 may be any appropriate type of connection including, but not limited to, an electrical wire or an optical fibre, or a wireless connection.

The second temperature sensor 26 is coupled to the first operating liquid pipe 32 between the heat exchanger 18 and the liquid ring pump 10. The second temperature sensor 26 is configured to measure a temperature of the operating liquid flowing (i.e. being pumped by the pump system 16) into the liquid ring pump 10 via the first operating liquid pipe 32. The second temperature sensor 26 may be any appropriate type of temperature sensor. The second temperature sensor 26 is connected to the controller 20 via a fourth connection 50 such that the measurements taken by the second temperature sensor 26 are sent from the second temperature sensor 26 to the controller 20. The fourth connection 50 may be any appropriate type of connection including, but not limited to, an electrical wire or an optical fibre, or a wireless connection.

Thus, an embodiment of the vacuum system 2 is provided.

Apparatus, including the controller 20, for implementing the above arrangement, and performing the method steps to be described later below, may be provided by configuring or adapting any suitable apparatus, for example one or more computers or other processing apparatus or processors, and/or providing additional modules. The apparatus may comprise a computer, a network of computers, or one or more processors, for implementing instructions and using data, including instructions and data in the form of a computer program or plurality of computer programs stored in or on a machine-readable storage medium such as computer memory, a computer disk, ROM, PROM etc., or any combination of these or other storage media.

Embodiments of control processes performable by the vacuum system 2 will now be described with reference to FIGS. 3 and 4. It should be noted that certain of the process steps depicted in the flowcharts of FIGS. 3 and 4 and described below may be omitted or such process steps may be performed in differing order to that presented below and shown in FIGS. 3 and 4. Furthermore, although all the process steps have, for convenience and ease of understanding, been depicted as discrete temporally-sequential steps, nevertheless some of the process steps may in fact be performed simultaneously or at least overlapping to some extent temporally.

The process described with reference to FIGS. 3 and 4 advantageously tend to provide for the intelligent handling of the variable and uncertain load conditions which may otherwise cause shutdown of the system, while simultaneously achieving improved water and energy savings.

Figure 3:
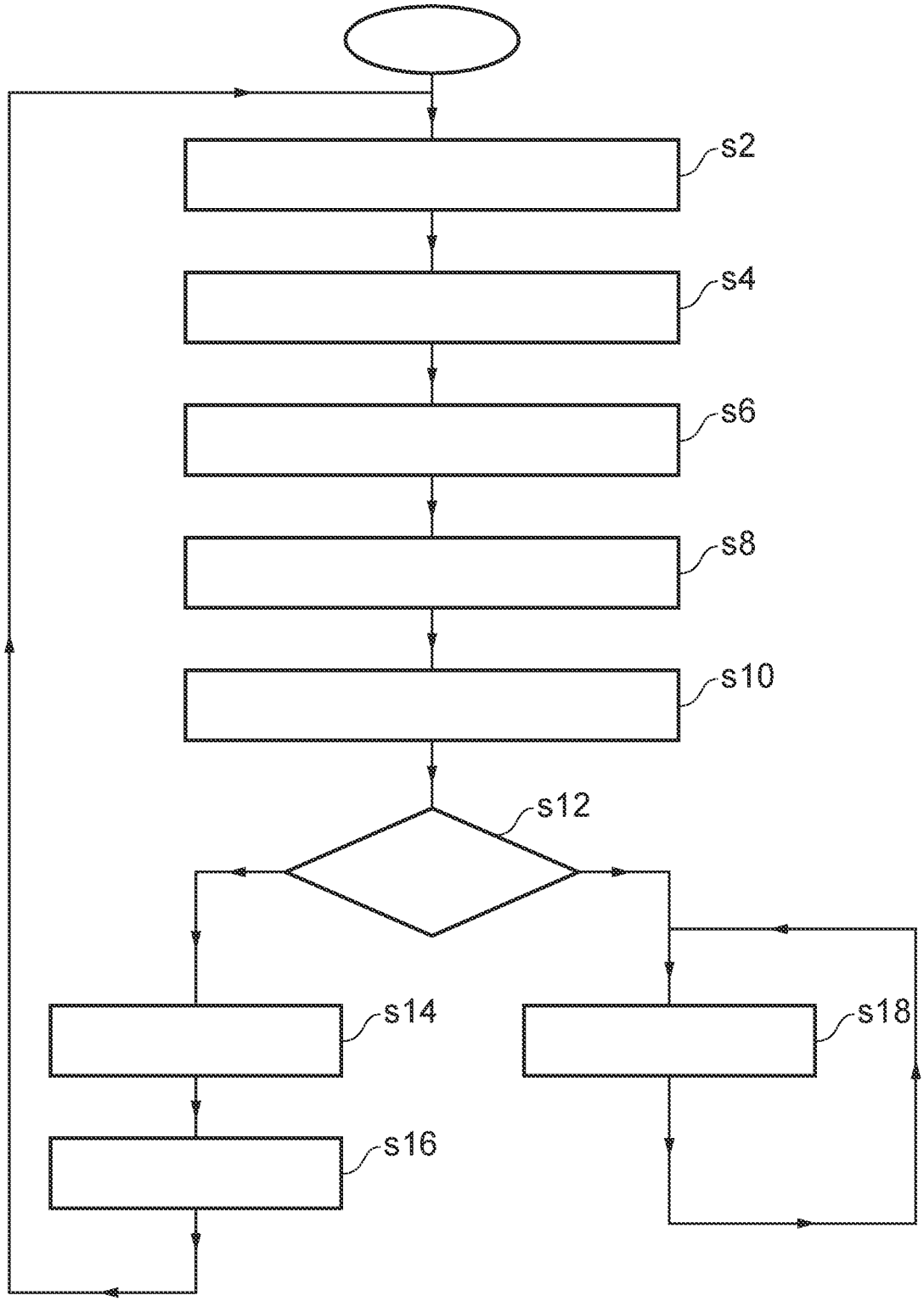
FIG. 3 is a process flow chart showing certain steps of a control process implemented by the vacuum system.

FIG. 3 is a process flow chart showing certain steps of an embodiment of a control process implemented by the vacuum system 2 in operation. The process of FIG. 3 may be regarded as an "anti-cavitation control" process.

At step s2, the first temperature sensor 24 measures a first temperature $T_1$. The first temperature $T_1$ is a temperature of the exhaust fluid of the liquid ring pump 10 flowing in the exhaust line 30, i.e. the temperature of the air and water mixture being pumped by the liquid ring pump 10 to the separator 14. The first temperature $T_1$ measurement is sent by the first temperature sensor 24 to the controller 20 via the third connection 48.

At step s4, the controller 20 determines or estimates the vapour pressure of the operating liquid in the liquid ring pump 10 using the measured first temperature $T_1$. In this embodiment, the operating liquid is water and, thus, the controller determines the vapour pressure of water for the first temperature $T_1$, which is hereafter referred to as "the water vapour pressure $P_{wv}$". In this embodiment, the water vapour pressure $P_{wv}$ is determined using an approximation formula, in particular the Antoine equation. The water vapour pressure $P_{wv}$ is determined as:

$$P_{wv} = A * 10^{\left(\frac{m*T_1}{T_1+T_n}\right)}$$

where: A is a constant value, for example, A may be between about 6.1 and 6.2, e.g. A=6.116441;

m is a constant value, for example, m may be between about 7.5 and 7.6, e.g. m=7.591306;

$T_n$ is a constant temperature value (in Kelvin), for example, $T_n$ may be between about 240 and 241 Kelvin, e.g. $T_n$=240.7263 K; and $T_1$ is the measured first temperature.

In some embodiments, one or more of the parameters A, m, and $T_n$ are defined for the liquid used in the liquid ring pump and/or may have different value to that given above.

At step s6, the controller 20 adds a so-called offset value to the determined water vapour pressure $P_{wv}$, thereby to determine an updated pressure value. Thus, in this embodiment the updated pressure value P is determined as:

$$P=P_{wv}+P_{offset}$$

where: $P_{offset}$ is the offset value.

The offset value $P_{offset}$ may be considered to be a safety margin. The offset value $P_{offset}$ may be any appropriate pressure value including but not limited to a value between 1 mbar and 10 mbar, e.g. 1 mbar, 2 mbar, 3 mbar, 4 mbar, 5 mbar, 6 mbar, 7 mbar, 8 mbar, 9 mbar, or 10 mbar. In some embodiments, use of the offset value $P_{offset}$ is omitted.

At step s8, the pressure sensor 22 measures a first pressure $P_1$, the first pressure $P_1$ being the pressure of the gas flowing in the suction line 28, i.e. the pressure $P_1$ of the gas being pumped from the facility 4 by the action of the liquid ring pump 10. The first pressure $P_1$ measurement is sent by the pressure sensor 22 to the controller 20 via the second connection 46.

At step s10, the controller 20 compares the measured first pressure $P_1$ to the determined updated pressure value P. In particular, in this embodiment, the controller 20 determines an error value as the difference between the measured first pressure $P_1$ and the determined updated pressure value P. Thus, the error value ΔP may be calculated as:

$$\Delta P=P_1-P$$

At step s12, the controller 20 compares the determined error value ΔP against a first threshold value. The first threshold value may be, for example, zero (0).

If at step s12, the controller determines that the error value ΔP is less than or equal to the first threshold value, i.e. if ΔP≤0, the method proceeds to s14.

However, if at step s12, the controller determines that the error value ΔP is greater than the first threshold value, the method proceeds to s18. Step s18 will be described in more detail later below.

At step s14, responsive to determining that the error value ΔP is less than or equal to the first threshold value, the controller 20 adjusts a control variable v(t) so as to increase the error value ΔP.

In this embodiment, the control variable v(t) is an operating speed of the motor of the pump system 16. The controller 20 may adjust the control variable v(t) to cause an increase in the error value ΔP by adjusting or varying the control variable v(t) in a way that would cause an increase in the operating speed of the motor of the pump system 16.

The increase in operating speed of the motor of the pump system 16 would tend to cause the pumping system 16 to pump more operating liquid into the liquid ring pump 10. This may increase the pressure within the liquid ring pump 10, and thus increasing the first pressure $P_1$.

This increase in operating speed of the motor of the pump system 16 would tend to cause the pumping system 16 to pump more relatively cool operating fluid into the liquid ring pump 10 (in a given time), which would tend to cause a decrease in the temperature of operating fluid in the liquid ring pump 10 (and also a decrease in $T_1$). This would tend to cause a reduction in the evaporation pressure of the operating liquid in the liquid ring pump 10.

Thus, the controller 20 may adjust the operating speed of the motor of the pumping system 16 to cause an increase in the error value ΔP.

In some embodiments, at step s14, responsive to determining that the error value ΔP is less than or equal to the first threshold value, the controller 20 adjusts a control variable v(t) so as to increase the operating speed of the motor of the pump system 16 to its maximum speed.

In this embodiment, the controller 20 is a proportional-integral (PI) controller. Thus, the controller 20 may applies correction/adjustment to the control variable v(t) based on proportional and integral terms, e.g., of the error value ΔP. The adjusted value of the control variable v(t) may be determined as a weighted sum of the control terms (i.e. of the proportional and integral parameters determined by the controller 20).

At step s16, the controller 20 controls the motor of the pump system 16 using the adjusted control variable v(t).

In particular, the controller 20 generates a control signal for the motor of the pump system 16 based on the adjusted control variable v(t) determined at step s14. This control signal is then sent from the controller 20 to the motor of the pump system 16 via the first connection 44. The motor of the pump system 16 operates in accordance with the received control signal. In particular, in this embodiment, the speed of the motor of the pump system 16 is increased resulting in an increase of the flow rate of the operating liquid into the liquid ring pump 10. This tends to cause an increase in the error value ΔP.

Increasing the error value ΔP means that the difference between the first pressure $P_1$ and the water vapour pressure $P_{wv}$ is increased. The pressure of the pumped gas within the liquid ring pump 10 is moved away from the water vapour pressure $P_{wv}$. This advantageously tends to reduce the likelihood of the inlet gas causing cavitation in the liquid ring pump 10.

After step s16, the process of FIG. 3 repeats, for example until the vacuum system 2 is shutdown. The process of FIG. 3 may be performed continually, or more preferably continuously during operation of the vacuum system 2.

Returning now to the case where, at step s12, the controller 20 determines that the error value ΔP is greater than the first threshold value, the method proceeds to s18.

Figure 4:
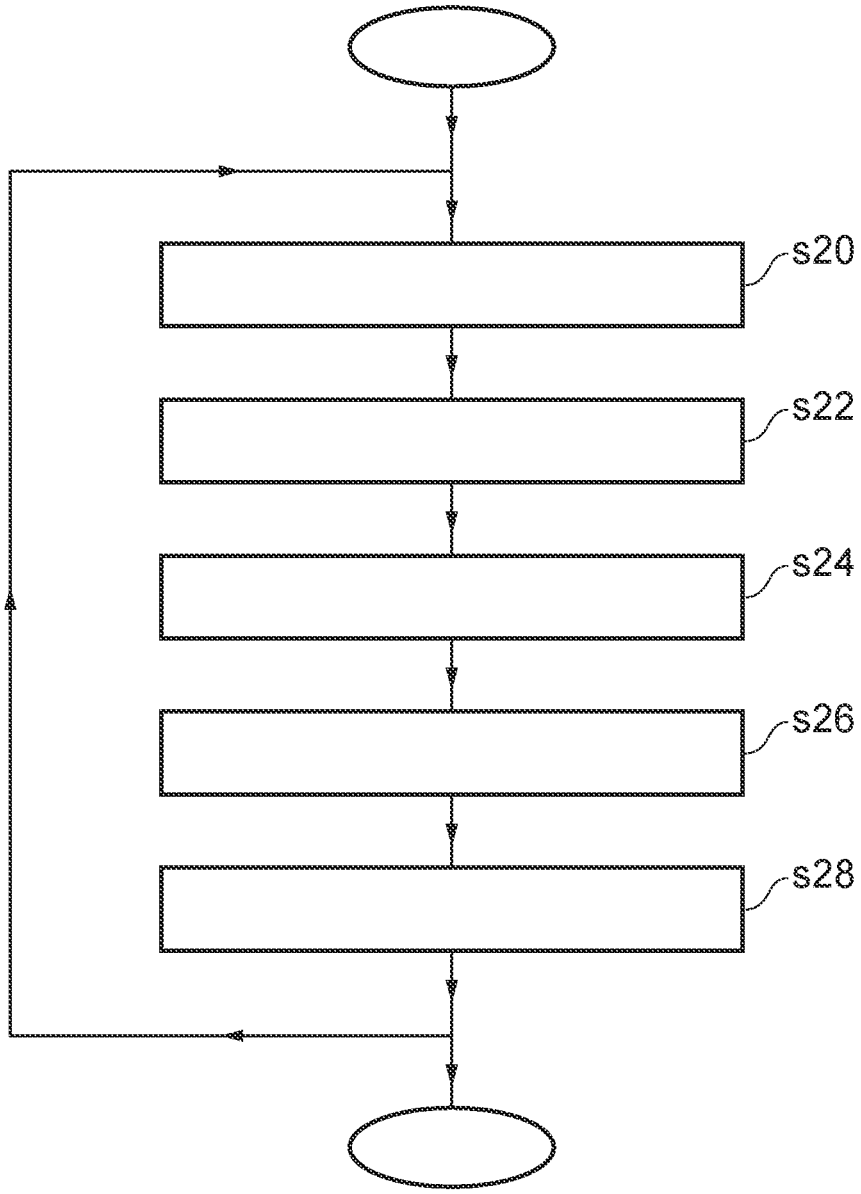
FIG. 4 is a process flow chart showing certain steps performed during the control process of FIG. 3.

At step s18, the control process of FIG. 4 is performed.

FIG. 4 is a process flow chart showing certain steps of the control process implemented by the vacuum system 2 at step s18 of the process of FIG. 3.

At step s20, the first temperature sensor 24 measures a first temperature $T_1$. The first temperature $T_1$ is a temperature of the exhaust fluid of the liquid ring pump 10 flowing in the exhaust line 30, i.e. the temperature of the air and water mixture being pumped by the liquid ring pump 10 to the separator 14. The first temperature $T_1$ measurement is sent by the first temperature sensor 24 to the controller 20 via the third connection 48.

At step s22, the second temperature sensor 26 measures a second temperature $T_2$. The second temperature $T_2$ is a temperature of the operating liquid being received by the liquid ring pump 10 via the first operating liquid pipe 32. The second temperature $T_2$ measurement is sent by the second temperature sensor 26 to the controller 20 via the fourth connection 50.

At step s24, the controller 20 determines a temperature difference as the difference between the measured first temperature $T_1$ and the measured second temperature $T_2$. Thus, in this embodiment, the temperature difference ΔT is calculated as:

$$\Delta T = T_1 - T_2$$

At step s26, the controller 20 acts to reduce or minimize the temperature difference ΔT by adjusting of the control variable $v_2(t)$.

In some embodiments, the controller 20 attempts to equalise the temperature difference ΔT with a second threshold value, or to cause the temperature difference ΔT to be within a first threshold range (e.g. a first threshold value+/−a constant). The second threshold value may be any appropriate value, for example 1° C., 1.5° C., 2° C., 2.5° C., or 3° C. The second threshold value may be determined by testing, for example to determine a threshold value associated with high or optimum liquid ring pump efficiency. The second threshold value may be dependent on a size or power of the liquid ring pump 10.

In some embodiments, the second threshold is a variable, e.g. that may be varied by a user of the system 2. For example, the second threshold may be set by a user depending on the fluid being pumped, the desired operation of the system, etc. The second threshold may be set to be equal to a first value for wet processes. The second threshold is set to be equal to a second value (different from the first value) for dry processes.

The term "wet processes" may be used to refer to processes, e.g. pumping processes, in which the process gas being pumped by the liquid ring pump system contains significant quantity of vapour (e.g. the percentage of vapour in the process gas is above a threshold percentage composition of vapour). In wet processes, the process gas may contain some liquid. In wet processes, the temperature of the process gas is usually high, e.g. above a threshold temperature. Examples of wet processes include, but are not limited, power station pumping processes, pumping steam from a turbine, and tire vulcanization processes.

The term "dry processes" may be used to refer to processes, e.g. pumping processes, in which the process gas being pumped by the liquid ring pump system does not contains a significant quantity of vapour (e.g. the percentage of vapour in the process gas is below a threshold percentage composition of vapour). In dry processes, the process gas does not contain liquid. In dry processes, the temperature of the process gas tends to be lower than in dry processes, e.g. below a threshold temperature. Examples of dry processes include, but are not limited to, the supply of a vacuum (e.g. by pumping air) to a facility for cleaning or holding.

In this embodiment, the controller 20 is a proportional-integral (PI) controller. Thus, the controller 20 applies correction/adjustment to the control variable v(t) based on proportional and integral terms of the temperature difference ΔT. The adjusted value of the control variable v(t) may be determined as a weighted sum of the control terms (i.e. of the proportional and integral parameters determined by the controller 20).

In this embodiment, if the temperature difference ΔT is too high, for example ΔT is above a threshold value such as the abovementioned second threshold value, the controller 20 increases the control variable v(t). As noted above, increasing the control variable v(t) corresponds to speeding up the pump system 16.

Similarly, if the temperature difference ΔT is too low, for example ΔT is below a threshold value such as the abovementioned second threshold value, the controller 20 decreases the control variable v(t). Decreasing the control variable v(t) corresponds to slowing down the pump system 16.

In this embodiment, if the temperature difference ΔT is equal to the second threshold value, the controller 20 maintains the control variable v(t). This corresponds to maintaining the current speed of the motor of the pump system 16.

At step s28, the controller 20 controls (using a VFD) the pump system 16 using the adjusted control variable v(t).

In particular, the controller 20 generates a control signal for the motor pump system 16 based on the adjusted control variable v(t) determined at step s8. This control signal is then sent from the controller 20 to the pump system 16 via the second connection 44. The pump system 16 operates in accordance with the received control signal.

Thus, in the event that the temperature difference ΔT is too high, the pump system 16 is sped up in accordance with the increased control variable v(t). Thus, the flow rate of relatively cool operating liquid into the liquid ring pump 10 is increased. This tends to cause a reduction in the first temperature $T_1$ measured by the first temperature sensor 24, thereby reducing the temperature difference ΔT.

Similarly, in the event that the temperature difference ΔT is too low, the pump system 16 is slowed down in accordance with the decreased control variable v(t). Thus, the flow rate of relatively cool operating liquid into the liquid ring pump 10 is decreased. This tends to cause an increase in the first temperature $T_1$ measured by the first temperature sensor 24, thereby increasing the temperature difference ΔT.

After step s28, the process of FIG. 4 repeats, for example until the vacuum system 2 is shutdown. The process of FIG. 4 may be performed continually, or more preferably continuously during operation of the vacuum system 2.

Thus, an embodiment of a control process implemented by the vacuum system 2 is provided. The control process comprises a control loop feedback mechanism in which continuously modulated control of the pump system 16 is performed.

Advantageously, the above described system and first control process allows for the control of operating liquid temperature in a liquid ring pump.

The above described system and control processes advantageously tends to provide for improved performance and efficiency of the liquid ring pump.

The above described system and control processes advantageously tend to reduce the likelihood of overloading the liquid ring pump with operating liquid. Furthermore, the likelihood and/or severity of hydraulic shock (also called "water hammer") tends to be reduced. This tends to reduce damage to the liquid ring pump. Advantageously, the above described system and first control process tends to provide reduced or minimised operating liquid consumption. The operating liquid tends to be recycled in the above described system and first control process. This tends to reduce operating costs of the liquid ring pump.

The above described system and control process advantageously tend to reduce the likelihood and/or severity of cavitation occurring in the liquid ring pump.

Advantageously, if the thermal load of the above described system is low, the pump system will tend to slow down. Thus, energy consumption tends to be reduced.

Advantageously, the above described system and control process tend to allow for the control of fluid temperatures and pressures within a liquid ring pump.

The above described system and control process advantageously tend to provide for improved reliability of the liquid ring pump.

The above described system and control process advantageously tend to reduce the likelihood and/or severity of cavitation occurring in the liquid ring pump. For example, cavitation may be caused in the liquid ring pump by the inlet pressure (i.e. the pressure of gas from the suction line) being at or below the vapour pressure of the operating liquid in the liquid ring pump. The above described control processes advantageously tend to adjust the pressure within the liquid ring pump to move it away from the vapour pressure of the operating liquid, thereby reducing the likelihood of cavitation. Thus, damage to the liquid ring pump caused by cavitation tends to be reduced or eliminated.

In the above embodiments, the vacuum system comprises the elements described above with reference to FIG. 1. In particular, the vacuum system comprises the non-return valve, the liquid ring pump, the motor, the separator, the pumping system, the controller, the pressure sensor, the first and second temperature sensors, and the connections therebetween. However, in other embodiments the vacuum system comprises other elements instead of or in addition to those described above. Also, in other embodiments, some or all of the elements of the vacuum system may be connected together in a different appropriate way to that described above. In some embodiments, multiple liquid ring pumps may be implemented.

In some embodiments, heating and/or cooling means may be arranged to heat and/or cool the operating liquid entering the liquid ring pump. For example, heating and/or cooling means may be coupled to the first operating liquid pipe 32, and be configured to heat/cool operating fluid therein.

In the above embodiments, a separator outputs from the system the separated operating liquid and the separated gas via respective output pipes. However, in other embodiments, the separated operating liquid and/or the separated gas are not output from the system. For example, in some embodiments the operating liquid is recycled back into the liquid ring pump from the separator. The recycling of the operating liquid advantageously tends to reduce operating costs and water usage. In some embodiments, the separator may be omitted.

In the above embodiments, the liquid ring pump is a single-stage liquid ring pump. However, in other embodiments the liquid ring pump is a different type of liquid ring pump, for example a multi-stage liquid ring pump.

In the above embodiments, the operating liquid is water. However, in other embodiments, the operating liquid is a different type of operating liquid.

In the above embodiments, the controller is a PI controller. However, in other embodiments, the controller is a different type of controller such as a proportional (P) controller, an integral (I) controller, a derivative (D) controller, a proportional-derivative controller (PD) controller, a proportional-integral-derivative controller (PID) controller, or a fuzzy logic controller.

In the above embodiments, a single controller controls operation of multiple system elements (e.g. the motors). However, in other embodiments multiple controllers may be used, each controlling a respective subset of the group of elements. For example, in some embodiments, each motor may have a respective dedicated controller.

In the above embodiments, the temperature difference is determined to be $\Delta T = T_1 - T_2$. However, in other embodiments the temperature difference is determined in a different way, for example using a different appropriate formula. For example, the temperature difference may be a different function of the first temperature $T_1$ and/or the second temperature $T_2$. For example, weights may be applied to the measured temperatures $T_1$ and $T_2$.

In the above embodiments, the Antoine equation is used to estimate the water vapour pressure $P_{wv}$ as $$P_{wv} = A * 10^{\left(\frac{m * T_1}{T + T_n}\right)}.$$

However, in other embodiments, the water vapour pressure is estimated in a different appropriate way, for example using a different approximation such as the August-Roche-Magnus (or Magnus-Tetens or Magnus) equation, the Tetens equation, the Buck equation, or the Goff-Gratch equation. In some embodiments, the water vapour pressure $P_{wv}$ is determined as $$P_{wv} = 20.386 - \frac{5132}{T_1}.$$

In the above embodiments, the error value ΔP is determined to be $\Delta P = P_1 - P$. However, in other embodiments the error value is determined in a different way, for example using a different appropriate formula. For example, the error value may be a different function of the first pressure $P_1$ and/or the first temperature $T_1$. In some embodiments, weights may be applied to the measured pressure $P_1$ and/or the updated pressure value P.

In the above embodiments, the motor of the pumping system is controlled to regulate or modulate flow of the operating liquid into the liquid ring pump. However, in other embodiments, one or more different type of regulating device is implemented instead of or in addition to the pumping system. The controller may be configured to control operation of the one or more regulating devices. For example, in some embodiments, the pumping system may be omitted and there may be one or more valves along the operating fluid line(s) 32, 40 for controlling a flow of operating fluid therethrough. In some embodiments, the pumping system is replaced by a proportional valve controlled by the controller. The proportional valve may be controlled in the same way as the pumping system, as described in more detail earlier above with reference to FIGS. 3 and 4, with the valve being opened to increase the flow of operating liquid into the liquid ring pump, and the valve being closed to decrease the flow of operating liquid into the liquid ring pump. In some embodiments, at step s14, responsive to determining that the error value ΔP is less than or equal to the first threshold value, the controller controls the one or more valves (e.g. one or more proportional valves) to open to its/their maximum extent. The use of one or more valves (e.g. one or more proportional valves) tends to be useful in embodiments where the supply of operating liquid from the operating liquid source has sufficient pressure to cause the operating liquid received by the liquid ring pump to be at a desired pressure. In some embodiments, both a pumping system and valve system are implemented to regulate the flow of operating liquid to the liquid ring pump.

Advantageously, the system is configured such that neither the maximum centrifugal pump speed nor the maximum proportional valve openness cause overload of the liquid ring pump.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

The invention claimed is:

1. A control system comprising:

a suction line;

an exhaust line;

an operating liquid line;

a liquid ring pump comprising a suction input coupled to the suction line, an exhaust output coupled to the exhaust line, and a liquid input coupled to the operating liquid line;

one or more regulating devices configured to control flow of operating liquid into the liquid ring pump;

a pressure sensor configured to measure a pressure of an input fluid received by the liquid ring pump via the suction line;

a first temperature sensor configured to measure temperature of an exhaust fluid output by the liquid ring pump via the exhaust line;

a second temperature sensor configured to measure temperature of an operating liquid received by the liquid ring pump via the operating liquid line; and a controller configured to:

using the temperature measurement of the exhaust fluid, determine or estimate a vapour pressure of the operating liquid in the liquid ring pump;

perform a first comparison, the first comparison being a comparison between a function of the measured pressure of the input fluid and a function of the determined or estimated a vapour pressure;

responsive to the first comparison fulfilling one or more criteria, control the one or more regulating devices to increase a flowrate of the operating liquid into the liquid ring pump;

responsive to the first comparison not fulfilling the one or more criteria, perform a second comparison, the second comparison being a comparison between a function of the temperature measurement of the exhaust fluid and a function of the temperature measurement of the operating liquid; and control the one or more regulating devices based on the second comparison.

2. The control system of claim 1, wherein the vapour pressure of the operating liquid is determined as:

$$P_{wv} = A * 10^{\left(\frac{m * T_1}{T_1 + T_n}\right)}$$

where: A is a constant value;

m is a constant value;

$T_n$ is a constant value; and $T_1$ is the temperature measurement of the exhaust fluid.

3. The control system of claim 1, wherein the first comparison comprises determining a difference between the measured pressure of the input fluid and some function of the determined or estimated a vapour pressure.

4. The control system of claim 3, wherein the one or more criteria comprises the criterion that the difference between the measured pressure of the input fluid and some function of the determined or estimated a vapour pressure is less than or equal to a first threshold value.

5. The control system of claim 4, wherein the first threshold is zero.

6. The control system of claim 1, wherein the controller is configured to, responsive to the first comparison fulfilling the one or more criteria, control the one or more regulating devices to increase the flowrate of the operating liquid into the liquid ring pump to a maximum flow rate.

7. The control system of claim 1, wherein the second comparison comprises determining a difference between the temperature measurement of the exhaust fluid and the temperature measurement of the operating liquid.

8. The control system of claim 7, wherein the controller is configured to, responsive to the difference between the temperature measurement of the exhaust fluid and the temperature measurement of the operating liquid being above a second threshold value, control the one or more regulating devices to increase the flowrate of the operating liquid into the liquid ring pump.

9. The control system of claim 7, wherein the controller is configured to, responsive to the difference between the temperature measurement of the exhaust fluid and the temperature measurement of the operating liquid being below a second threshold value, control the one or more regulating devices to decrease the flowrate of the operating liquid into the liquid ring pump.

10. The control system of claim 7, wherein the controller is configured to, responsive to the difference between the temperature measurement of the exhaust fluid and the temperature measurement of the operating liquid being equal to a second threshold value, control the one or more regulating devices to maintain a current flowrate of the operating liquid into the liquid ring pump.

11. The control system of claim 8, wherein the second threshold is variable.

12. The control system of claim 8, wherein the second threshold is set to be equal to a first value for wet processes, and the second threshold is set to be equal to a second value for dry processes, the first value being different to the second value.

13. The control system according to claim 1, wherein the controller is a controller selected from the group of controllers consisting of a proportional controller, an integral controller, a derivative controller, a proportional-integral controller, a proportional-integral derivative controller, a proportional-derivative controller, and a fuzzy logic controller.

14. The control system according to claim 1, one or more regulating devices comprises one or more devices selected from the group of devices consisting of: a pump, a centrifugal pump, a valve, a proportional valve.

15. A method for controlling a system, the system comprising a suction line an exhaust line, an operating liquid line, a liquid ring pump comprising a suction input coupled to the suction line, an exhaust output coupled to the exhaust line, and a liquid input coupled to the operating liquid line, one or more regulating devices configured to control flow of operating liquid into the liquid ring pump, a pressure sensor, a first temperature sensor, and a second temperature sensor, the method comprising:

measuring, by the pressure sensor, a pressure of an input fluid received by the liquid ring pump via the suction line;

using a temperature measurement of the exhaust fluid, determining or estimating a vapour pressure of the operating liquid in the liquid ring pump;

performing a first comparison, the first comparison being a comparison between a function of the measured pressure of the input fluid and a function of the determined or estimated a vapour pressure;

responsive to the first comparison fulfilling one or more criteria, controlling the one or more regulating devices to increase a flowrate of the operating liquid into the liquid ring pump;

measuring, by the first temperature sensor, a temperature of an exhaust fluid output by the liquid ring pump via the exhaust line;

measuring, by the second temperature sensor, a temperature of an operating liquid received by the liquid ring pump via the operating liquid line;

responsive to the first comparison not fulfilling the one or more criteria, performing a second comparison, the second comparison being a comparison between a function of the temperature measurement of the exhaust fluid and a function of the temperature measurement of the operating liquid; and controlling the one or more regulating devices based on the second comparison.

* * * * *